US006382291B2

(12) United States Patent
Ronalds

(10) Patent No.: US 6,382,291 B2
(45) Date of Patent: May 7, 2002

(54) DISPENSER FOR SELF-ADHESIVE MATERIAL

(76) Inventor: Lyle A. Ronalds, 601 E. Anapamu St., Suite 31, Santa Barbara, CA (US) 93103

( * ) Notice: Subject to any disclaimer, the term of this patent is extended or adjusted under 35 U.S.C. 154(b) by 0 days.

(21) Appl. No.: 09/850,840

(22) Filed: May 7, 2001

Related U.S. Application Data

(63) Continuation of application No. 09/111,133, filed on Jul. 3, 1998.

(51) Int. Cl.[7] ..... B65C 1/02; B65C 11/00

(52) U.S. Cl. ..... 156/540; 156/574; 156/577; 156/DIG. 33; 225/54

(58) Field of Search ..... 156/574, 577, 156/579, 540; D19/67; 225/54; 118/200, 257

(56) References Cited

U.S. PATENT DOCUMENTS

| | | | |
|---|---|---|---|
| 3,444,840 | A | 5/1969 | DeMarco |
| 3,764,439 | A | 10/1973 | Rome |
| 4,447,482 | A | 5/1984 | Heinzelman et al. |
| 4,570,868 | A | 2/1986 | Wiggs et al. |
| 4,685,994 | A | 8/1987 | Wodnicki |
| 4,718,971 | A | 1/1988 | Summers |
| 4,770,322 | A | 9/1988 | Slota et al. |
| 4,954,208 | A | 9/1990 | Hamisch, Jr. et al. |
| 5,472,560 | A | 12/1995 | Horng |
| 5,779,852 | A | 7/1998 | Haney et al. |
| 5,851,347 | A | 12/1998 | Rodriguez |
| 6,029,849 | A | 2/2000 | Meshulam |

OTHER PUBLICATIONS

Premier Self Adhesive Stamp Affixer, 1977, 2 pages Martin Yale Industries, 251 Wedcor Avenue, Wabash, IN.

*Primary Examiner*—Richard Crispino
*Assistant Examiner*—Sue A. Purvis
(74) *Attorney, Agent, or Firm*—Leo F. Costello

(57) ABSTRACT

A device for separating stick-on material, such as self-adhesive stamps from a roll of backing tape to which the stick-on material is adhered, for dispensing and applying the stick-on material onto an application surface, and for storing the empty tape. The device provides a chamber for holding a supply roll of backing tape and stick-on material so that backing tape and adhered stick-on material can be payed out from the roll in a first direction. The tape is guided along a path that causes the tape initially to extend in said first direction and then in a second direction angularly related to the first direction so that as the tape changes direction it separates from the stick-on material. A drive member, conveniently a roller, engages the application surface and the tape after it has been separated from the stick-on material so that movement of the drive member over the surface by hand manipulation of the device causes the drive member to pull the empty tape from the holding chamber and move it along the path to a take-up chamber. As the device and drive member continue to be moved, the stick-on material is dispensed on and applied to the surface and the empty tape is stored in the take-up chamber.

36 Claims, 6 Drawing Sheets

DISPENSER FOR SELF-ADHESIVE MATERIAL

RELATED APPLICATION

This application is a continuation of my prior copending application Ser. No. 09/111,133 filed Jul. 3, 1998, entitled Dispenser For Self-Adhesive Material.

FIELD

The present invention pertains to a dispenser for self-adhesive material and more particularly to a self-adhesive stamp dispenser.

BACKGROUND

As is well known self-adhesive stamps are very popular for personal or small business mailings. These stamps are sold very lightly adhered to a backing material from which the stamps can be easily removed and applied to an envelope without licking or other moistening. The adhesive on the stamp interacts with a special coating on the backing material to allow only light adhesion but tenaciously attaches to an envelope.

The backing material is either a flat sheet or a tape wound into a roll. Each stamp is individually peeled from the backing material and attached to an envelope. In fact, it is difficult to remove a strip of stamps together because adjacent stamps are very tenuously connected, if at all, on the backing material. This is in contrast to rolls of moistenable stamps which must be torn apart along perforations to separate one stamp from another.

Various types of containers have long been available for storing rolls of stamps whether of the moistenable type or the self-adhesive type. With such a container, the tape on which the self-adhesive stamps are affixed is manually pulled out of the container and each stamp is manually peeled from the roll and applied. Although such containers are useful, there are advantages to dispensing the stamps mechanically, especially for small business use. Self-adhering stamps lend themselves to such mechanization.

Applicant is unaware of any mechanized stamp dispenser for self-adhesive stamps in the patent literature. Various patented; devices are known, however, for dispensing self-adhesive materials other than postage stamps. Such dispensers are shown in U.S. Pats. Nos. 4,447,482 to Heinzelman et al., 5,470,868 to Wiggs et al., and 4.718.971 to Summers, and 5,472,560 to Horng. Wiggs et al, Summers, and Horng patents all have a cost disadvantage in that they require gear mechanisms to rotate the take-up or drive reels. The Heinzelman et al. patent would not be effective for dispensing self-adhesive postage stamps since it depends on the strength and integrity of the self-adhesive material to accomplish the dispensing action. Heinzelman et al.'s device may be suitable for dispensing adhesive tape for medical purposes, but it would not function to dispense postage stamps that are only lightly connected, if at all, to each other.

A self-adhesive stamp dispenser is commercially available and is sold under the trademark "Premiere Stamp Affixer." This device, like the Wiggs et al., Summers, and Horng patents, uses gears to drive the take up reel and thus advance the tape and move stamps to be dispensed into a dispensing position. Since cost and simplicity are desirable attributes for a self-adhesive stamp dispenser, the Premiere dispenser does not provide an optimum solution.

SUMMARY

A device is provided for separating stick-on material, such as self-adhesive stamps, from a roll of backing tape to which the stick-on material is adhered and for dispensing the stick-on material onto an application surface. The device provides a chamber for holding a roll of backing tape and stick-on material so that backing tape and adhered stick-on material can be payed out from the roll in a first direction. The tape is guided along a path that causes the tape initially to extend in said first direction and then in a direction angularly related to the first direction so that as the tape changes direction, it separates from the stick-on material. A drive member engages the application surface and the tape after it has been separated from the stick-on material. Movement of the drive member over the surface by manipulating the device causes the drive member to pull the tape from the holding chamber and to move it along the path to a take-up chamber for the empty tape. As the device continues to be moved, the stick-on material is dispensed onto the surface.

An object of this invention is to provide a simple, low cost, and dependable dispenser for self-adhesive materials.

Another object is to provide a dispenser for self-adhesive postage stamps that includes a minimum number of moldable parts.

A further object is to provide a self-adhesive material dispenser that does not require gears or a gear mechanism for its operation.

An additional object is to provide a dispenser for self-adhesive material that separates the stamps from the tape and advances the tape into an empty tape take-up chamber in response to movement of the dispenser over the surface on which the self-adhesive material is to be applied but which does not use a gear mechanism to rotate the supply or take-up rolls.

A significant feature of this invention is the use of a roller that engages the empty tape and surface on which the stamps or other sell-adhesive material is to be applied and causes the stamps to be separated from the tape while moving the empty tape into the take-up chamber.

A still further object is to provide a self-adhesive material dispenser that can easily be loaded and which requires only a single stamp to be removed in order to initiate the dispensing action.

Yet an additional object is to provide a self-adhesive postage stamp dispenser which can be easily opened for loading and also for observing the supply of stamps still remaining in the dispenser.

A still further object is to provide a self-adhesive stamp dispenser from which the empty tape can be easily removed without disassembling the dispenser.

An additional object is to provide a self-adhesive postage stamp dispenser that is easily operated in one hand of the user for applying a single stamp or a strip of stamps and which firmly presses the stamps being applied onto to the application surface. Another object is to provide a dispenser for self-adhesive postage stamps that is particularly useful for small businesses where the necessary postage involves more than one stamp.

These and other objects will become apparent upon reference to the following description and claims and to the accompanying drawings.

DETAILED DESCRIPTION

Figure 1:
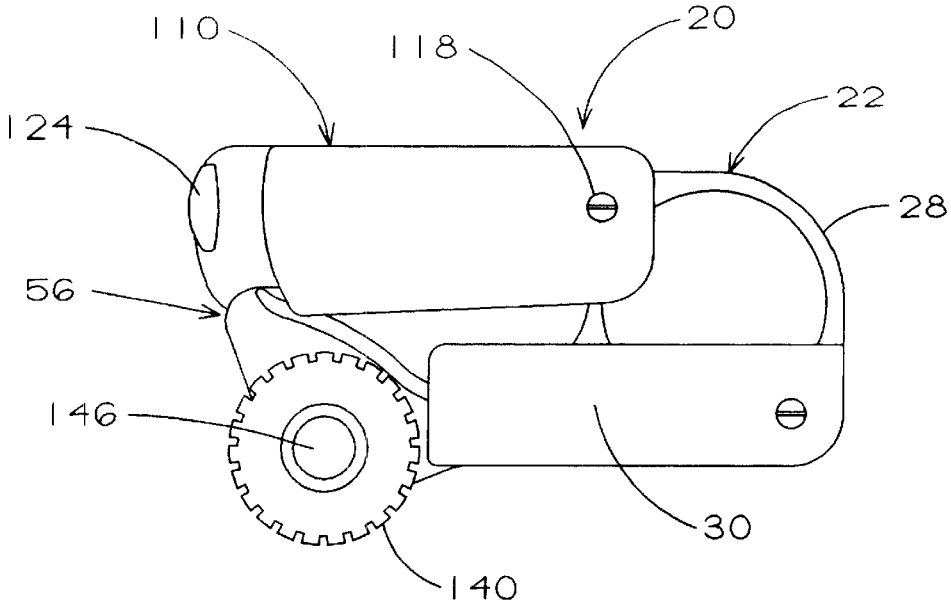
FIG. 1 is a side elevation of the dispenser of the present invention with the cover in closed position.
Figure 2:
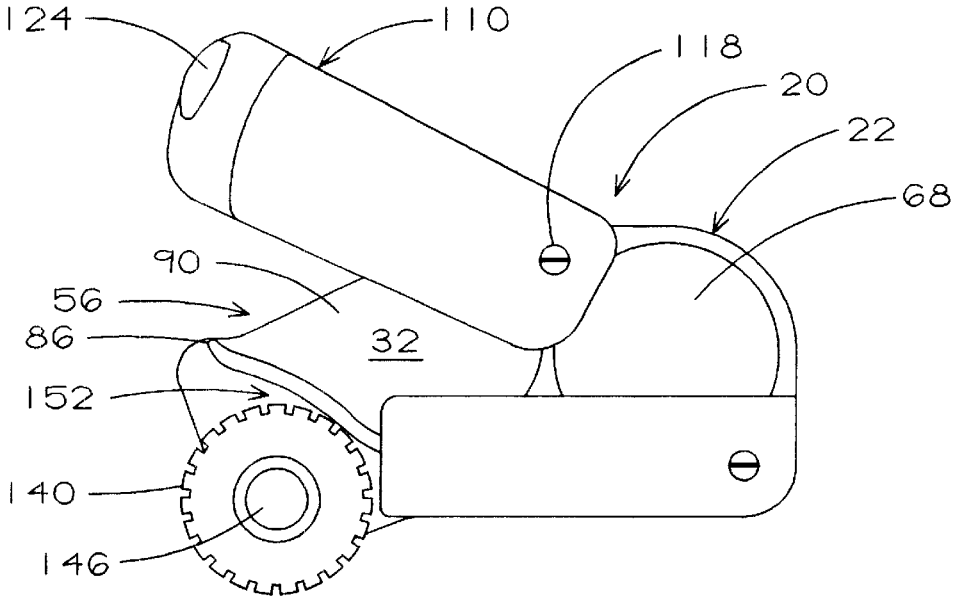
FIG. 2 is a side elevation similar to FIG. 1 but with the cover in its open position.
Figure 3:
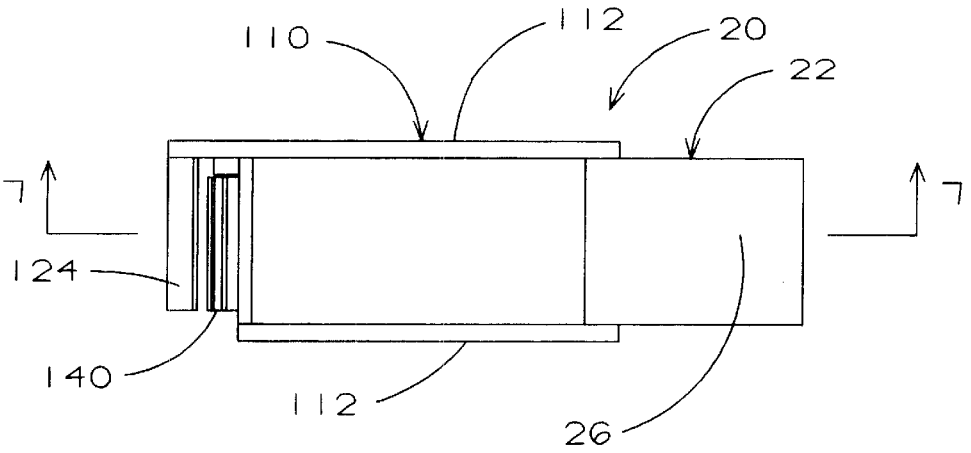
FIG. 3 is a top plan view of the dispenser as shown in FIG. 1.
Figure 4:
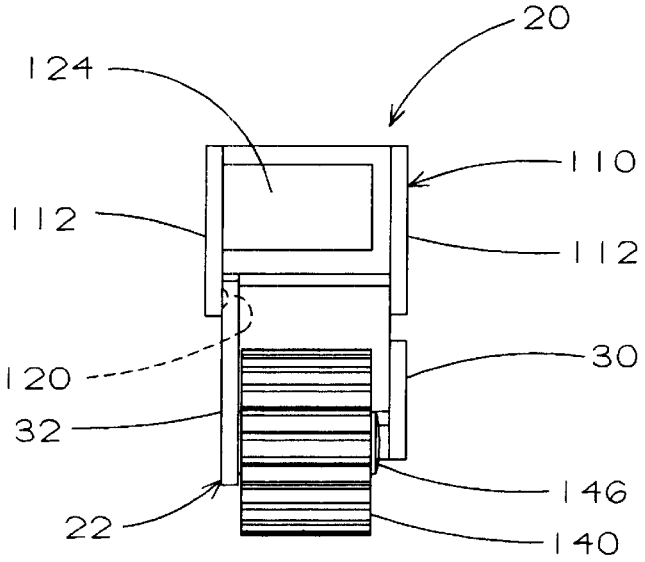
FIG. 4 is a front elevation of the dispenser as shown in FIG. 1.
Figure 5:
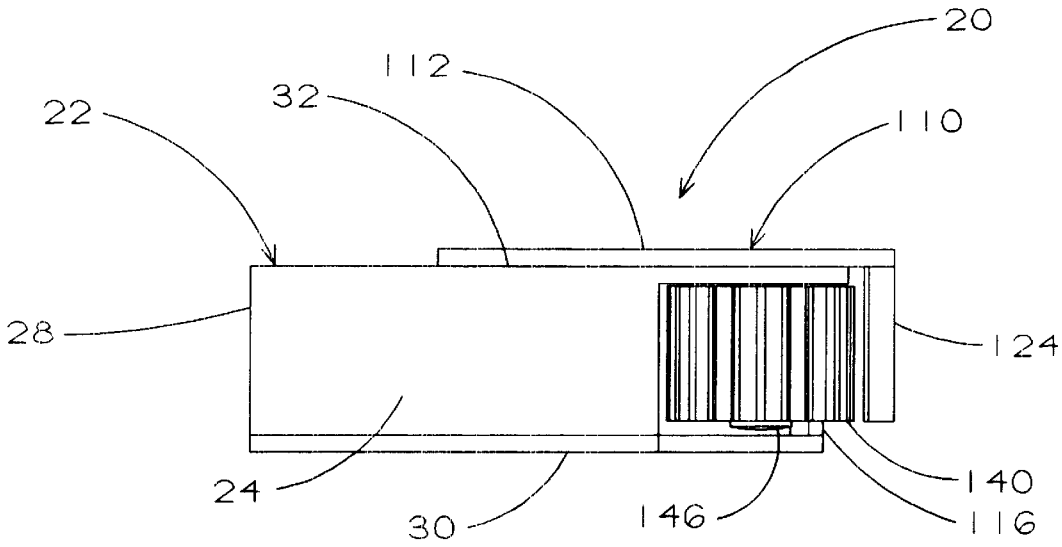
FIG. 5 is a bottom plan view of the dispenser shown in FIG. 1.
Figure 6:
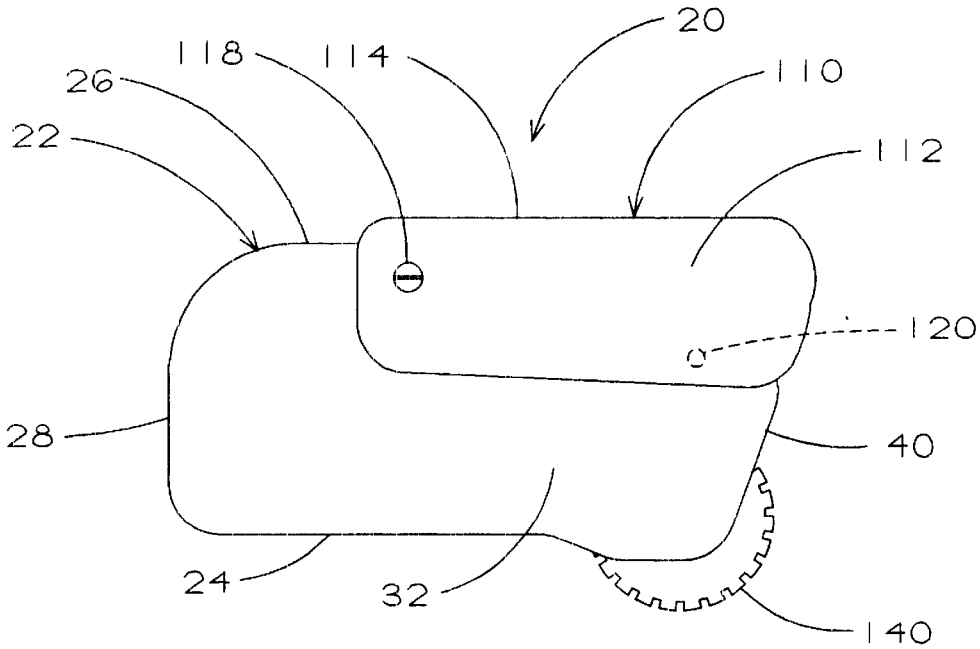
FIG. 6 is a side elevation looking at the opposite side of the dispenser from that shown in FIG. 1.

A self-adhesive stamp dispenser incorporating the principals of the present invention is generally indicated by the numeral 20 in the drawings. With particular reference to FIGS. 1 through 8, the dispenser includes a housing 22 preferably molded of a suitable plastic and having a bottom wall 24, a top wall 26, a rear wall 28, and left and right side walls 30 and 32, respectively. Although the left side wall is shown as a removable rectangular panel, it may have the same shape as the right side wall and be integral with the housing. The reference to "left" and "right" is from a position looking down on the dispenser and facing forwardly and is only for descriptive convenience.

Figure 7:
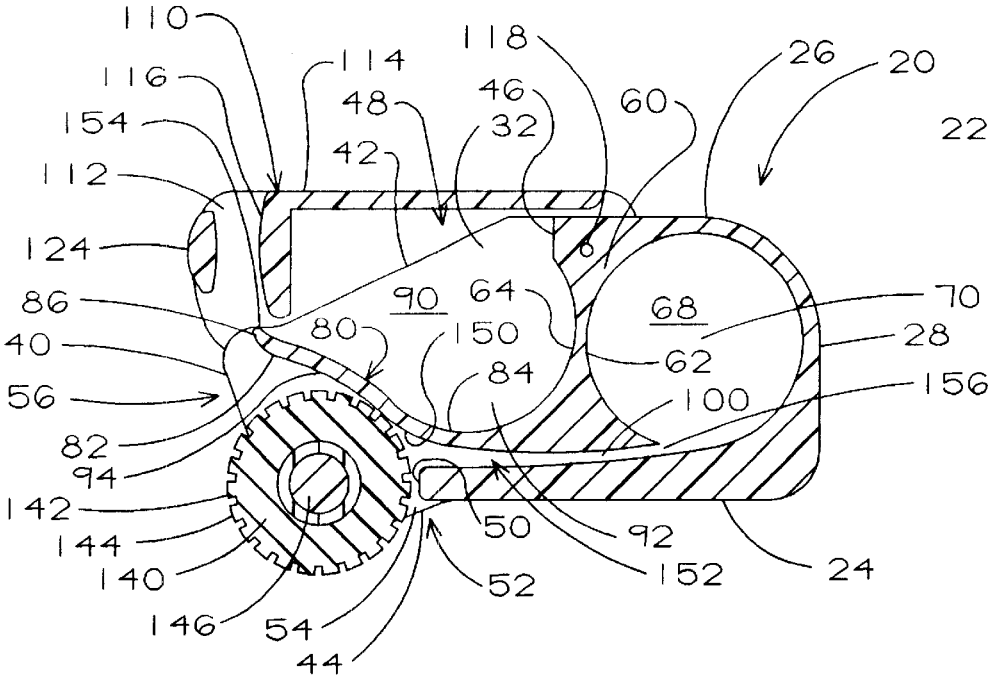
FIG. 7 is a longitudinal vertical section taken along line 7—7 in FIG. 3.
Figure 8:
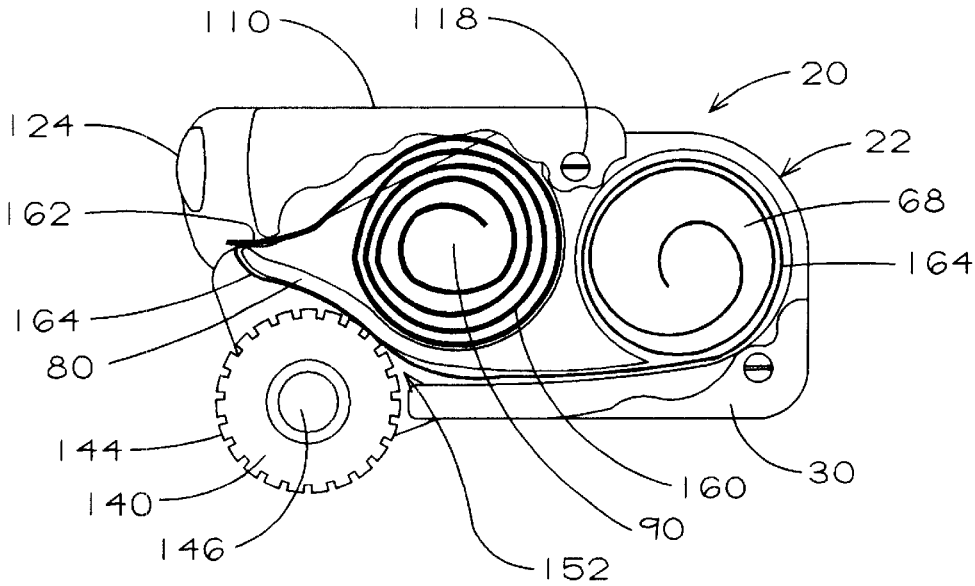
FIG. 8 is a side elevation similar to FIG. 1 but with parts broken away to show a roll of self-adhesive postage stamps on a backing tape both in a supply chamber and in an empty tape take-up chamber that are part of the dispenser of the present invention.

With particular reference to FIG. 7, the side walls 30 and 32 have generally vertical front edges 40 and upper and lower edges 42 and 44. The top wall 26 terminates in a front edge 46 that is rearwardly spaced from the front edge of the right side wall 32 thereby to define a top opening 48 of the housing 22. Similarly, the bottom wall 24 terminates in a front edge 50 spaced rearwardly from the front edge of the right side wall so as to define a bottom opening 52 in the housing. The right side wall has a lower front projection 54 that extends below the bottom wall at this bottom opening 52. Furthermore, the front edges of the side walls define a front opening 56 for the housing.

An intermediate wall 60 (FIG. 7) extends downwardly from the top wall 26 internally of the housing 22 and has rearwardly and forwardly facing concave surfaces 62 and 64 that are segments of a cylinder. The rearwardly facing concave surface substantially completes a cylindrical surface formed by the top, rear, bottom and intermediate walls 26, 28, 24, and 60 that defines a cylindrical rear empty tape, take-up chamber 68. For purposes of subsequent reference, this take-up chamber has an axis indicated by the number 70.

A guidewall 80 (FIG. 7) extends forwardly from the intermediate wall 60 internally of the housing 22 and has a lower surface 82, an upper surface 84 and terminates in an elongated transversely extending front tip 86. The upper surface of the guidewall partially continues the cylindrical shape of the forwardly facing concave surface 64 of the intermediate wall 60 thereby defining a front supply chamber 90 having an axis 92 parallel with the axis 70 of the take-up chamber 68. The guidewall extends forwardly with a slight serpentine shape to the tip. The lower surface of the guidewall has a slightly concave segment 94 just rearwardly of the tip, for a purpose to be described. Furthermore, the lower surface of the guide wall and the lower surface of the intermediate wall form one continuous surface that is in closely spaced relation to the bottom wall 24 thereby defining a rear guide way 100.

A cover 110 (FIGS. 1, 2, and 7) is provided for the housing 22 having left and right side walls 112, a top wall 114, and a front wall 116 that extends perpendicularly downwardly from the top wall. The side walls of the cover are attached to the side walls 30 and 32 of the housing by pivots 118 that are parallel to the axes 70 and 92. The cover is thus mounted for movement between an open position (FIG. 2) allowing access to the supply chamber 90 through the top and front openings 48 and 56 and a closed position (FIGS. 1 and 7) wherein the cover extends over the top opening and extends partially over the front opening with the front wall in closely spaced relation just above the tip 86. The right side wall of the cover and the right side wall 32 of the housing are provided with detents 120 (FIG. 4) in order to releasably hold the cover in its closed position. Furthermore, an elongated, transversely extending, stamp-engaging nose 124 extends between the side walls 112 of the cover forwardly of the front wall 116. The nose has a front convex surface for a purpose to be described. In the closed position of the cover, this nose is positioned forwardly and upwardly from the tip 86.

The subject stamp dispenser 20 also includes a roller 140 of resiliently compressible material, such as rubber, and preferably of twenty durometer rubber. The roller has a peripheral tread 142 preferably composed of equally spaced ribs 144 that extend radially outwardly of the roller and also axially of the roller in parallel relation to the axes 70 and 92. The roller is mounted on a shaft 146 that extends outwardly from the lower front projection 54 of the right side wall 32 of the housing. The shaft thus defines an axis for the roller that is parallel to the axes 70 and 92 and is spaced downwardly and rearwardly from the tip 86 and forwardly of the front edge 50 of the bottom wall 24. Furthermore, the periphery of the roller is in closely spaced relation to the forward edge of the bottom wall and is in resiliently compressible engagement with the lower surface 82 of the guidewall 80 rearwardly of the tip 86.

The roller and the guidewall define a forward guideway 150 (FIG. 7) that is aligned with the rear guideway 100. The forward and rearward guideways and the tip 86 define a path 152 for empty tape having an entrance end at the supply chamber 90 and adjacent to the tip 86 and an exit end opening into the take-up chamber 68. It will be understood that the axes 70 and 92, the axis defined by the shaft 146, the longitudinal dimensions of the tip 86 and the nose 124, and the ribs 144 are all disposed transversely of this path.

Operation

In use, the cover 110 (FIGS. 2, 7, and 8) is opened, and a roll 160 of self-adhesive stamps 162 is positioned in the supply chamber 90. The roll of stamps is the typical roll of one hundred stamps about one and one-eighth inch in diameter when full as sold by the U.S. Postal Service having a backing tape 164 to which the stamps are lightly adhered. As is well known, this backing tape has a special coating that allows the sell-adhesive surfaces of the stamp to adhere lightly to the tape but allows the stamps to be readily peeled away from the tape without affecting the self-adhesive character of the stamps. The roll of stamps is placed in the supply chamber so that the free end or leader of the tape extends forwardly off the top of the roll and forwardly toward the front opening 56 of the housing. As viewed in FIG. 8, the roll is disposed in the supply chamber for unwinding in a counterclockwise direction.

After the supply roll 160 is placed in the supply chamber 90 (FIGS. 8 and 9) a leader of tape 164 and stamps 162 is pulled through the front opening 56 of tile housing 22 over the tip 86 to expose the leading stamp 162, the leader is pulled down away from this first stamp. The leader of empty tape is then threaded into the forward guideway 150 between the guidewall 80 and the roller 140. As the leader is so positioned the leading, stamp projects through the front opening and is removed. It is significant that, in contrast to known stamp dispensers, only one stamp needs to be removed in order to load the subject dispenser for operation. Alter the leader of empty tape has been threaded between and frictionally grasped by the roller and the guidewall, the cover 110 is closed and latched shut by the detent 120.

Figure 9:
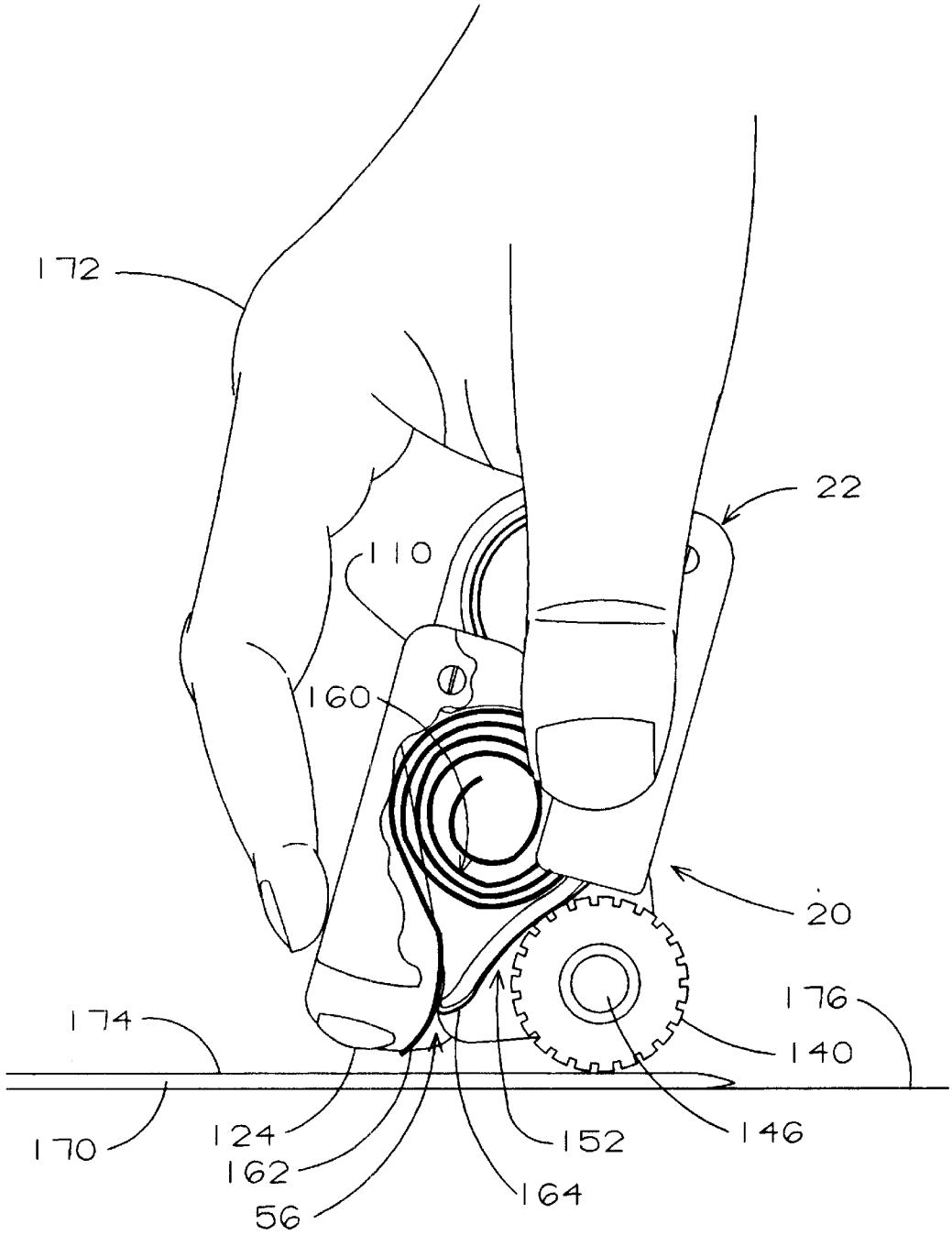
FIGS. 9 and 10 are operational views of the subject dispenser being held in the hand of the user over an envelope on which a stamp or stamps are being applied and with parts being broken away to show interior details.
Figure 10:
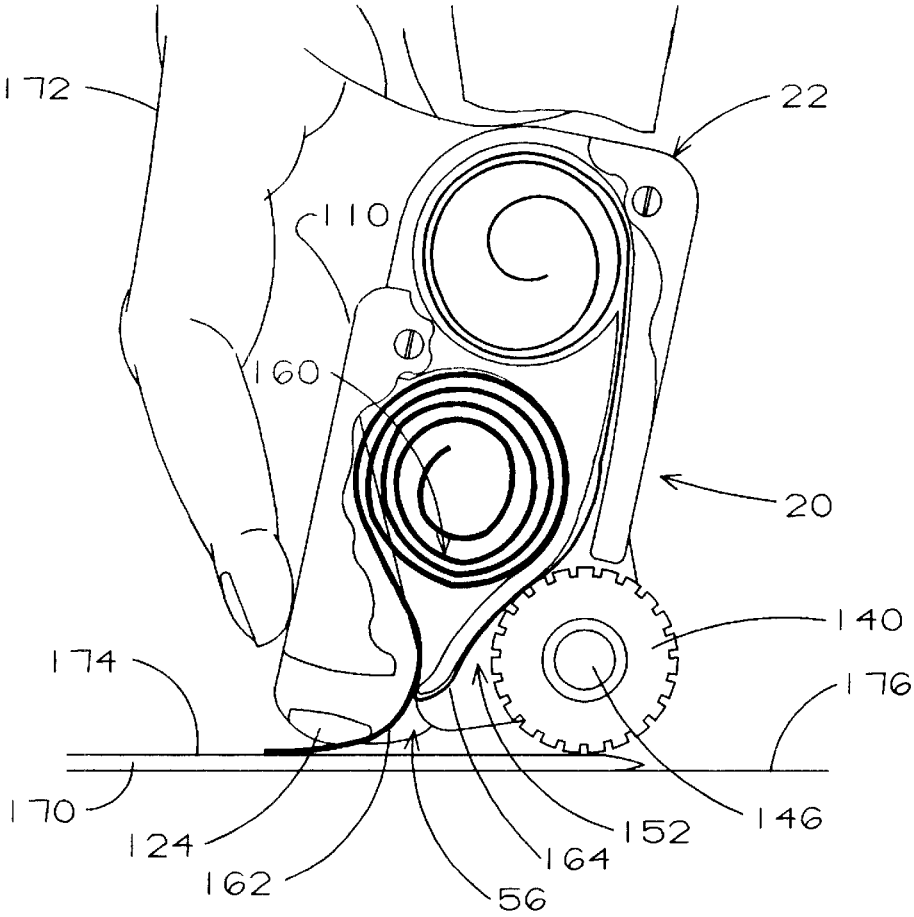
Figure 11:
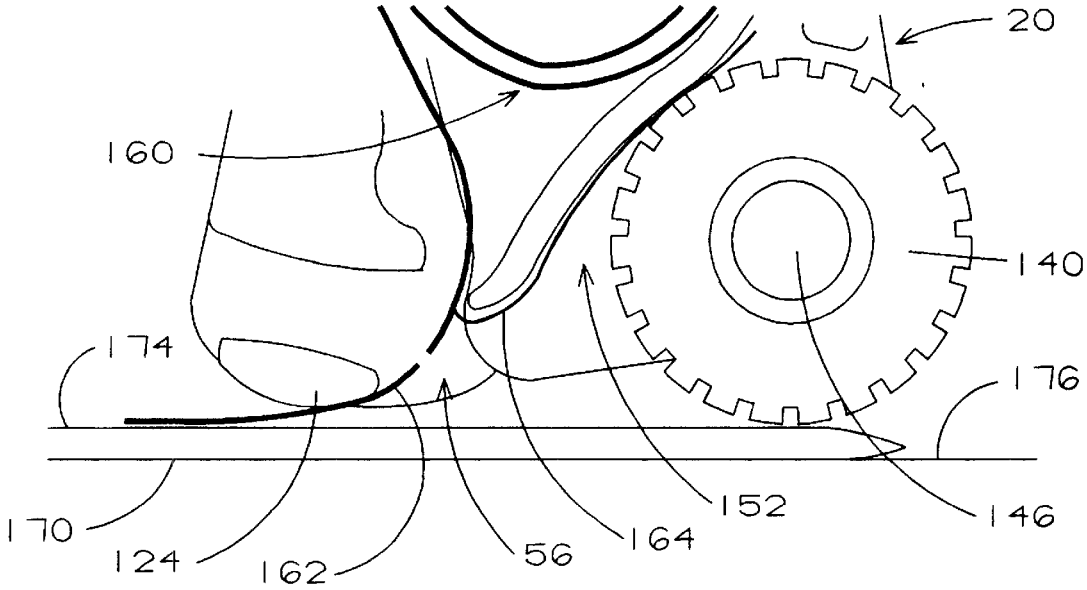
FIG. 11 is a somewhat enlarged fragmentary view of a portion of the subject dispenser as shown in FIGS. 9 and 10 and showing in more detail how the dispenser operates to dispense stamps and advance the backing tape to the take-up chamber.

With the stamp dispenser 22 loaded with a roll of stamps 160, as above described. the dispenser is now ready to be used to apply stamps to an envelope, generally indicated by the numeral 170 (FIGS. 9 and 10). To use the dispenser, it is grasped in the user's hand 172 as shown in FIGS. 9 and 10. For a right-handed person, the user's thumb grasps the left side wall 30, the user's forefinger engages the cover 110, and the user's remaining fingers engage the right side wall 32. The roller 140 is next placed on the application surface 172 of the envelope or the support surface 176 on which the envelope is resting. depending on how many stamps are to be dispensed or where the stamps are to be located on the envelope and is tipped or tilted forwardly on the roller acting as a fulcrum. The dispenser is then moved rearwardly relative to the envelope, causing the roller 140 to rotate clockwise in FIGS. 9 through 11. In turn, this causes the upper periphery of the roller to move rearwardly relative to the guidewall 80 and thereby to drive the empty tape 164 rearwardly along the path 152 because of the frictional engagement of the roller with the tape, pressing it against the guidewall and moving it rearwardly. As the leader of the empty tape moves along the path, it eventually passes through the exit 156 into tile take-up chamber where the cylindrical surface thereof causes the tape to wind into an empty roll.

Rearward movement of the dispenser 20 (FIGS. 9 through 11) as described above, also causes the stamps 162 to be moved forwardly through the front opening 56 of the housing 22 as the tape 164 is pulled downwardly and rearwardly from the stamps by the action of the roller 140 against the empty tape and the guidewall 80. Because of the very light adhesion of the stamps to the tape, once the first stamp has been peeled from the backing tape, continued downward and rearward movement of the tape relative to the stamps, causes the tape to be separated from the stamps. At the same time, the roller thus pulls the tape with affixed stamps out of the supply chamber 90 forwardly in the housing 22 causing the stamps to move, one by one through the front opening 56.

With the stamp dispenser 20 (FIGS. 9 through 11) tilted forwardly on the roller 140, the separated stamps 162 project out under the nose 124 onto the envelope 170. By further tilting the dispenser forwardly, the nose is pressed downwardly against the stamp being applied thereby to press it tightly against the envelope. If only one stamp is desired, the dispenser is lifted after the single stamp has been applied. If multiple stamps are desired, the dispenser is moved rearwardly far enough to apply as many stamps as is desired, the nose sliding along on and firmly pressing each of the stamps against the envelope.

It is to be noted that adjacent stamps 162 in a roll of self-adhesive stamps are very tenuously connected to each other, if at all, along a tear line. As such, when each stamp is applied to the envelope 170, or when the last stamp of a strip of several stamps has been applied to the envelope, it is very easy to pull the dispenser 20 away from the applied stamp or stamps without pulling the supply of stamps out of the supply chamber 90. If desired, the nose 124 could be provided with a knife edge to bear down against the juncture between the last stamp and the next succeeding stamp to make the separation. However, because of the light connection between adjacent stamps, such a cutting function has not been found to be necessary.

Apart from dispensing and applying stamps 162 (FIGS. 8 through 10), the stamp dispenser 20 also conveniently stores the used or empty backup tape 164 in the take-up chamber 68. When the roll 160 has been depleted of all of the stamps 162, and while a trailing length to empty tape is between the roller and guidewall 80, the roller 140 is rotated in a counter-clockwise direction (FIGS. 9 or 10) to move the empty tape forwardly through the path 152. Alternatively, the trailing end of the empty tape can simply be pulled forwardly through or along the path so as to be pulled out of the take-up chamber 70. The used backup take is thrown away and the stamp dispenser is ready to be reloaded.

From the foregoing, it will be understood that a very simple, inexpensive, yet dependable stamp dispenser 20 has been provided. The dispenser essentially has only three parts: namely, the housing 22, the cover 110, and the roller 140. Of these, only the cover and the roller are movable. As such, no gears or other complicated mechanisms are involved that might malfunction or breakdown. The housing and the cover are easily molded thereby reducing manufacturing costs. As previously mentioned, only one stamp needs to be removed to initiate the loading and operation of the dispenser.

Although a preferred embodiment of the present invention has been shown and described, various modifications and substitutions may be made thereto without departing from the spirit and scope of the present invention. Accordingly, it is to be understood that the present invention has been described by way of illustration and not limitation.

What is claimed is:

1. A device for separating and dispensing stick-on material from a roll of backing tape to which the stick-on material is adhered, comprising:

an elongated tape guide member having front and rear ends and upper and lower surfaces, an empty-tape chamber at the rear end of the guide member, a holding chamber for a roll of backing tape to which stick-on material is adhered located adjacent to the upper surface of the guide member rearwardly of the front end, and a resiliently compressible roller mounted in fixed spaced relation to the guide member in frictional rollable engagement with the lower surface of the guide member rearwardly of the front end when the tape is not present and being maintained in said rollable engagement with the guide member by said mounting when the tape is not present.

2. The device of claim 1, wherein the roller is mounted for rotation on an axis spaced below the lower surface of the guide member and rearwardly of the front end, and wherein the axis is in fixed spaced relation to the guide member.

3. The device of claim 2, wherein there is a guidewall extending rearwardly from the roller in spaced relation below the guide member, and wherein the guide member and the guidewall form a guideway aligned with the area of engagement of the roller and the guide member and extending from the roller into the take-up chamber.

4. A device for separating stick-on material from a roll of backing tape to which the stick-on material is adhered and dispensing the stick-on material onto an application surface, comprising:

means for holding a roll of backing tape and stick-on material so that backing tape and adhered stick-on material can be payed out from the roll in a first direction, means for guiding the tape along a path that initially extends in said first direction and then extends in a second direction angularly related to the first direction so that as the tape changes direction, it separates from the stick-on material, resiliently compressible roller means engageable with the application surface or a support thereunder and with the tape on the path after the tape has been separated from the stick-on material and frictionally grasping the tape between the roller means and the guiding means, so that movement of the roller means over the surface causes the roller means to pull the tape from the holding means and move it along the path in said second direction, whereby the stick-on material can be dispensed onto the surface, the roller means having an axis of rotation, and means mounting the roller means with its axis in fixed spaced relation to the guiding means so that the roller means is maintained in engagement with the guiding means when no tape is between the guiding means and the roller means and the roller means is not in engagement with the application surface but allows entry of the tape between the guiding means and the roller means.

5. The device of claim 4, wherein the guiding means provides a continuous smooth path opposite to the roller means, wherein the roller means presses against said path with a pressure sufficient to frictionally grasp the tape and move it along the path upon rotation of the roller means, and wherein the roller means is sufficiently resiliently compressible to allow entry of the tape between the guiding means and the roller means.

6. The device of claim 5, wherein the path is concave where the roller means engages the path.

7. The device of claim 4, wherein the roller means is a roller in peripheral engagement with the path.

8. The device of claim 7, wherein the roller has a rubber periphery.

9. The device of claim 4, including means for receiving tape that has been separated from the stick-on material, wherein the path extends to the receiving means, and wherein rotation of the roller means moves the separated tape into the receiving means.

10. The device of claim 1, wherein means are engageable with stick-on material that has been applied to an application surface for pressing the stick-on material against the application surface.

11. A device for separating and dispensing stick-on material from a roll of backing tape to which the stick-on material is adhered, comprising:

means for holding a supply roll of backing tape and stick-on material so that tape and adhered stick-on material can be payed out from the roll and the tape can be separated from the stick-on material, means spaced from the holding means for receiving empty-tape after it has been separated from the stick-on material, means for guiding tape that has been separated from the stick-on material along a path from the holding means to the receiving means, resiliently compressible drive means, and means mounting the drive means in resiliently compressibly slidable engagement with the path but is otherwise in fixed relation to the path for receiving empty tape from the holding means between the guiding means and the drive means, for pressing the empty tape against the guiding means, and for applying a force to the tape that moves the tape along the path toward the receiving means.

12. The device of claim 11, wherein the drive means is a roller whose axis is in fixed spaced relation to the path.

13. A device for separating and dispensing postage stamps from a roll of backing tape to which the stamps are lightly adhered, comprising:

a housing having a front, a rear, a bottom and a top, an intermediate wall in the housing spaced between the front and the rear thereof and terminating in spaced relation to the bottom wall, the top, bottom, and sides of the housing and the intermediate wall defining an empty tape take-up chamber therebetween, a guidewall extending forwardly from the intermediate wall in closely spaced relation to the bottom wall thereby defining a rear guideway therebetween, said guide wall also extending upwardly from the bottom wall and terminating in a front tip spaced above the bottom of the housing, the sides and guidewall defining a supply chamber forwardly of the intermediate wall and opening at the front of the housing, and a resiliently compressible roller rotatably mounted between the side walls under and in resilient engagement with the guidewall, defining a forward guideway therebetween aligned with the rear guideway, and projecting from the bottom of the housing, the roller having an axis of rotation that is in fixed spaced relation to the guidewall.

14. The device of claim 13, wherein the axis of the roller is spaced below and rearwardly of the tip.

15. The device of claim 13, wherein there is a nose on the front of the housing above and forwardly of the tip and engageable with a stamp on the application surface after it is applied to the surface thereby to press the stamp against the surface.

16. The device of claim 13, wherein there is a cover attached to the housing and movable between a closed position over the supply chamber and an open position extending angularly upwardly from the closed position.

17. A device for separating stick-on material such as postage stamps from a roll of backing tape to which the stick-on material is adhered and dispensing the stick-on material onto an application surface, comprising:

a housing having a pair of elongated longitudinally extending side walls, a rear wall interconnecting the side walls, a bottom wall interconnecting the side walls and extending forwardly from the rear wall, and a top wall extending forwardly from the rear wall;

an intermediate wall extending down from the top wall in longitudinally spaced relation to the rear wall and terminating in spaced relation to the bottom wall, the top, bottom, side and the intermediate walls defining a substantially cylindrical empty tape take-up chamber therebetween;

a guidewall extending forwardly from the intermediate wall in closely spaced relation to the bottom wall thereby defining a rear guideway therebetween, said guidewall also extending upwardly from the bottom wall and terminating in a front tip spaced above the bottom of the housing, the intermediate and guidewall also extending transversely of the housing between the side walls, the side, intermediate, and guide walls defining a supply chamber forwardly of the intermediate wall and opening at the top and at the front of the housing;

a cover pivotally attached to the housing and movable to and from positions closing and opening the top of the supply chamber;

a resiliently compressible roller rotatably mounted in the housing on an axis in fixed spaced relation below and rearwardly of the tip, under and in resilient engagement with the guidewall, defining a forward guideway therebetween aligned with the rear guideway, and projecting from the bottom of the housing; and a nose on the front of the housing above and forwardly of the tip and engageable with a stamp on the application surface after it is applied to the surface thereby to press the stamp against the surface.

18. The device of claim 17, wherein the roller has a peripheral tread of rubber.

19. A device for separating and dispensing stick-on material from a roll of backing tape to which the stick-on material is adhered, comprising:

an elongated tape guide member having first and second ends and first and second oppositely directed surfaces, the second surface serving as a guiding surface along which the tape travels after it has been separated from the stick-on material, an empty-tape receiving chamber at the second end of the guide member, a holding chamber for a roll of backing tape to which stick-on material is adhered located adjacent to the first end and the first surface of the guide member, a resiliently compressible drive member supported in resiliently compressible frictional engagement with the second surface of the guide member adjacent to the first end when no tape is present along said second surface and movably mounted for movement toward the empty-tape receiving chamber and relative to the guide member while in such frictional engagement, a support mounted in fixed spaced relation to said second surface, and the drive member being mounted on the support.

20. In a device for dispensing stick-on material from a roll of backing tape to which the stick-on material is adhered, a housing having a top, a bottom and opposite sides;

an elongated tape guideway mounted within the housing;

tape supply and take-up chambers and a tape dispensing opening disposed within the housing in spaced relation to each other along the guideway, the guideway thereby providing a tape path extending from the supply chamber past the dispensing opening to the take-up chamber; and a tape drive moveably mounted on the housing and disposed along the path between the supply and take-up chambers, the housing having first and second wall portions pivoted on the housing for movement between a closed position over the supply and take-up chambers respectively and an open position exposing openings to their respective chambers large enough to allow movement of a tape roll therethrough, said openings being accessible at either the side or the top of the housing when their respective wall portions are in open position and providing direct access by the user to their respective chambers.

21. The device of claim 20, wherein the supply chamber is adjacent to the dispensing opening and between the dispensing opening and the take-up chamber.

22. The device of claim 20, wherein the guideway extends from the dispensing opening past the tape drive, thence under the supply chamber and into the take-up chamber.

23. The device of claim 20, wherein both the take-up and the supply chambers are visible exteriorly of the housing when the first and second wall portions are in closed positions.

24. In the device of claim 20, wherein the housing, the supply and take-up chambers and the guide way are integrally connected to each other.

25. In the device of claim 20, wherein there are no gears for moving the tape along the path.

26. In the device of claim 20, wherein the housing has forward and rearward ends and top and bottom portions;

wherein the dispensing opening is at the forward end of the housing;

wherein the take-up chamber is at the rearward end of the housing;

wherein the supply chamber is adjacent to the dispensing opening and between the dispensing opening and the take-up chamber;

wherein the guideway extends from the dispensing opening under the supply chamber to the take-up chamber; and wherein the tape drive is adjacent to the dispensing opening and under the guideway.

27. A device for unwinding a roll of stamps, for separating stamps unwound from the roll, and for dispensing the separated stamps onto an application surface, the roll having a leading end, comprising:

a chamber for holding such a roll of stamps;

a guiding member defining a guide path along which the leading end may extend as the roll is unwound;

a driving member having a resiliently compressible drive surface; and a support mounting the driving member with its drive surface in movable resiliently compressible frictional engagement with the guiding member along the guide path but allowing such a leading end to enter between the drive surface and the guiding member whereby movement of the driving member over the guiding member causes the drive surface to move such leading end along the path and whereby pressing the driving member against the application surface and moving it along the surface imparts driving movement to the driving member, the support maintaining the drive surface in resiliently compressible engagement with the guiding member without having to press the roller against the application surface thereby to facilitate feeding of said leading end between the driving member and the guiding member.

28. The dispenser of claim 27, wherein the support is mounted in fixed spaced relation to the guiding member.

29. The dispenser of claim 27, wherein the guiding member is an elongated solid wall, and wherein the drive surface is in resiliently compressible engagement with the wall.

30. The dispenser of claim 27, wherein the driving member is a roller with a resiliently compressible periphery.

31. A device for unwinding a roll of stamps, for separating stamps unwound from the roll, and for dispensing the separated stamps onto an application surface, the roll having a leading end, comprising:

a chamber for holding such a roll of stamps;

an elongated guiding member extending from the chamber and defining a guide path along which the leading end may be guided as it is unwound from the roll;

drive means having a resiliently compressible drive surface; and means for mounting the drive means with its drive surface in movable resiliently compressible engagement with the guiding member along the guide path and for movement over the application surface but allowing the unwound leading end to enter between the drive surface and the guiding member whereby movement of the driving member over the application surface causes the drive surface to move the leading end along the path, said mounting means being in fixed spaced relation to the guiding member and maintaining the drive surface in continuous resiliently compressible engagement with the path when the driving member is not in engagement with the application surface thereby to facilitate feeding of the leading end between the driving member and the guiding member.

32. The dispenser of claim 31, wherein the drive means is a roller having a resiliently compressible cylindrical ribbed drive surface and an axis of rotation, wherein the guiding member is a solid wall, and wherein said axis is in fixed spaced relation to the wall.

33. A device for separating and dispensing stick-on material from a roll of backing tape to which the stick-on material is adhered, comprising:

an elongated tape guideway, an empty-tape chamber, a holding chamber for a roll of backing tape to which stick-on material is adhere, each of the chambers being adjacent to the guideway, and a resiliently compressible roller mounted in fixed spaced relation to the guideway and in frictional rollable engagement with the guideway when no tape is present.

34. A device for unwinding a roll of stamps, for separating stamps unwound from the roll, and for dispensing the separated stamps onto an application surface, the roll having a leading end, comprising:

a chamber for holding such a roll of stamps;

a guideway defining a guide path along which the leading end may extend as the roll is unwound;

a driving member having a resiliently compressible drive surface; and a support mounting the driving member with its drive surface in movable resiliently compressible frictional engagement with the guideway along the guide path while allowing such leading end to enter between the drive surface and the guideway and be frictionally engaged therebetween whereby movement of the driving member relative to the guideway causes the drive surface to move such leading end along the path and whereby pressing the driving member against the application surface and moving it along the surface imparts driving movement to the driving member, the support maintaining the drive surface in resiliently compressible engagement with the guideway before the leading end enters between the guideway and the driving member without having to press the driving member against the application surface thereby to facilitate feeding of said leading end between the driving member and the guideway.

35. A device for unwinding a roll of stamps, for separating stamps unwound from the roll, and for dispensing the separated stamps onto an application surface, the roll having a leading end, comprising:

a chamber for holding such a roll of stamps;

an elongated guideway extending from the chamber and defining a guide path along which the leading end may be guided as it is unwound from the roll;

drive means having a resiliently compressible drive surface; and means for mounting the drive means with its drive surface in movable resiliently compressible engagement with the guideway along the guide path and for movement over the application surface while allowing such leading end to enter between the drive surface and the guideway and be frictionally engaged therebetween, whereby movement of the driving member over the application surface causes the drive surface to move the leading end along the path, said mounting means being in fixed spaced relation to the guideway and maintaining the drive surface in continuous resiliently compressible engagement with the guideway when the driving member is not in engagement with the application surface and before the leading end enters between the guideway and the driving member, thereby to facilitate feeding of the leading end between the guideway and the driving member.

36. In a device for dispensing stick-on material from a roll of backing tape to which the stick-on material is adhered, a housing having a top, a bottom and opposite sides;

an elongated tape guideway mounted within the housing;

tape supply and take-up chambers and a tape dispensing opening disposed within the housing in spaced relation to each other along the guideway, the guideway thereby providing a tape path extending from the supply chamber past the dispensing opening to the take-up chamber; and a tape drive moveably mounted on the housing and disposed along the path, the housing having first and second wall portions pivoted on the housing for movement between a closed position over the supply and take-up chambers respectively and an open position exposing openings to their respective chambers large enough to allow movement of a tape roll therethrough, said openings being accessible externally of the housing when their respective wall portions are in open position and providing direct access by the user to their respective chambers.

* * * * *